US011185875B2

(12) United States Patent
Koehler et al.

(10) Patent No.: US 11,185,875 B2
(45) Date of Patent: Nov. 30, 2021

(54) SHOWER CADDY WITH 4-WAY DIVERTER

(71) Applicant: MAGNA DEA, LLC, Thornton, CO (US)

(72) Inventors: Jessica Koehler, Thornton, CO (US); Robert Koehler, Thornton, CO (US)

(73) Assignee: MAGNA DEA, LLC, Thornton, CO (US)

( * ) Notice: Subject to any disclaimer, the term of this patent is extended or adjusted under 35 U.S.C. 154(b) by 265 days.

(21) Appl. No.: 16/400,637

(22) Filed: May 1, 2019

(65) Prior Publication Data

US 2019/0336997 A1 Nov. 7, 2019

Related U.S. Application Data

(60) Provisional application No. 62/664,977, filed on May 1, 2018.

(51) Int. Cl.

| | |
|---|---|
| ***B05B 9/00*** | (2006.01) |
| ***A47K 3/28*** | (2006.01) |
| ***E03C 1/046*** | (2006.01) |
| ***E03C 1/044*** | (2006.01) |

(52) U.S. Cl.

CPC ..... *B05B 9/002* (2013.01); *A47K 3/281* (2013.01); *E03C 1/044* (2013.01); *E03C 1/046* (2013.01)

(58) Field of Classification Search

CPC ..... B05B 9/002
USPC ..... 4/598, 596
See application file for complete search history.

(56) References Cited

U.S. PATENT DOCUMENTS 5,255,401 A * 10/1993 Sambrookes ..... A47K 3/281 206/77.1
5,680,933 A * 10/1997 Miller ..... A47K 3/281 132/309
9,250,029 B1 2/2016 Moore
2004/0083545 A1 5/2004 Hudson
(Continued)

FOREIGN PATENT DOCUMENTS

CN 206130303 U 4/2017
CN 107468126 A 12/2017
KR 2017-0119033 A 10/2017

OTHER PUBLICATIONS

Oasis Shower Diffuser, https://oasisdiffusers.com, accessed May 2, 2019, pp. 1-8, Shopify.

(Continued)

*Primary Examiner* — Lori L Baker
(74) *Attorney, Agent, or Firm* — Holzer Patel Drennan

(57) ABSTRACT

A shower caddy includes a 4-way diverter for attachment to a shower arm and to divert water received from the shower arm to a circuit of pipes within the shower caddy. The shower caddy further includes a heating circuit within a basin. The basin holds bathing fluids, and the heating circuit transfers heat from water traveling via the circuit of pipes to the bathing fluids within the basin. The shower caddy further includes an additive infuser attached to the circuit of pipes that infuses an additive into the water flowing through the circuit of pipes when the additive infuser is activated by a user. The circuit of pipes is further connected to a showerhead that outputs the water received from the shower arm following it being used for the heating circuit and/or having an additive infused therein.

18 Claims, 9 Drawing Sheets

(56) References Cited

U.S. PATENT DOCUMENTS

2009/0272449 A1 11/2009 Craig
2013/0161329 A1* 6/2013 Baines ..... A47K 3/281
220/476

OTHER PUBLICATIONS

PCT Search Report from corresponding PCT Application No. PCT/US2019/030232, dated Jul. 15, 2019.
PCT Written Opinion from corresponding PCT Application No. PCT/US2019/030232, dated Jul. 15, 2019.

* cited by examiner

SHOWER CADDY WITH 4-WAY DIVERTER

CROSS-REFERENCE TO RELATED APPLICATIONS

The present application claims benefit of priority to U.S. Provisional Patent Application No. 62/664,977, entitled "Shower Caddy with Oil Infuser and Heating Assembly," and filed on May 1, 2018, which specifically incorporated by reference herein.

BACKGROUND

Shower caddies are typically oriented below a showerhead in a shower and are used to store bathing supplies (e.g., soaps, shampoos, washcloths, and so on), particularly in showers with limited alternative storage places. Typical shower caddies do not fluidly connect to the showerhead or a pipe leading thereto and thus do not incorporate any ability to enhance the shower water or use the shower water to enhance the user's showering experience.

SUMMARY

This Summary is provided to introduce a selection of concepts in a simplified form that is further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following, more particular written Detailed Description of various implementations as further illustrated in the accompanying drawings and defined in the appended claims.

An example shower caddy accordingly to the presently disclosed technology comprises a heated fluid dispenser and a 4-way diverter. The heated fluid dispenser includes a basin to store a quantity of bathing fluid and a heating circuit extending through the basin to conduct thermal energy from heated potable water flowing through the heating circuit to the bathing fluid within the basin. The 4-way diverter includes a first input to receive the heated potable water, a first output to direct the heated potable water to the heating circuit, a second input to receive the heated potable water back from the heating circuit, and a second output to direct the heated potable water out of the shower caddy.

Another example shower caddy accordingly to the presently disclosed technology comprises a 4-way diverter and an additive infuser. The 4-way diverter includes a first input to receive heated potable water, a first output to direct the heated potable water through a circuit of pipes, a second input to receive the heated potable water with an additive fluid back from the circuit of pipes, and a second output to direct the heated potable water with the additive fluid out of the shower caddy. The additive infuser includes a reservoir to store a quantity of the additive fluid and a user selector to selectively release the additive fluid from the reservoir into the heated potable water flowing through the circuit of pipes connected to the 4-way diverter.

An example method of using a shower caddy accordingly to the presently disclosed technology comprises receiving heated potable water from a potable water source into a 4-way diverter, directing the heated potable water out of the 4-way diverter and to a heating circuit, heating a quantity of bathing fluid stored within a basin using the heating circuit, which extends through the basin to conduct thermal energy from the heated potable water flowing through the heating circuit to the bathing fluid within the basin, receiving the heated potable water back into the 4-way diverter from the heating circuit, and directing the heated potable water out of the 4-way diverter to a showerhead.

These and various other features and advantages will be apparent from a reading of the following Detailed Description.

BRIEF DESCRIPTIONS OF THE DRAWINGS

DETAILED DESCRIPTION

Figure 1:
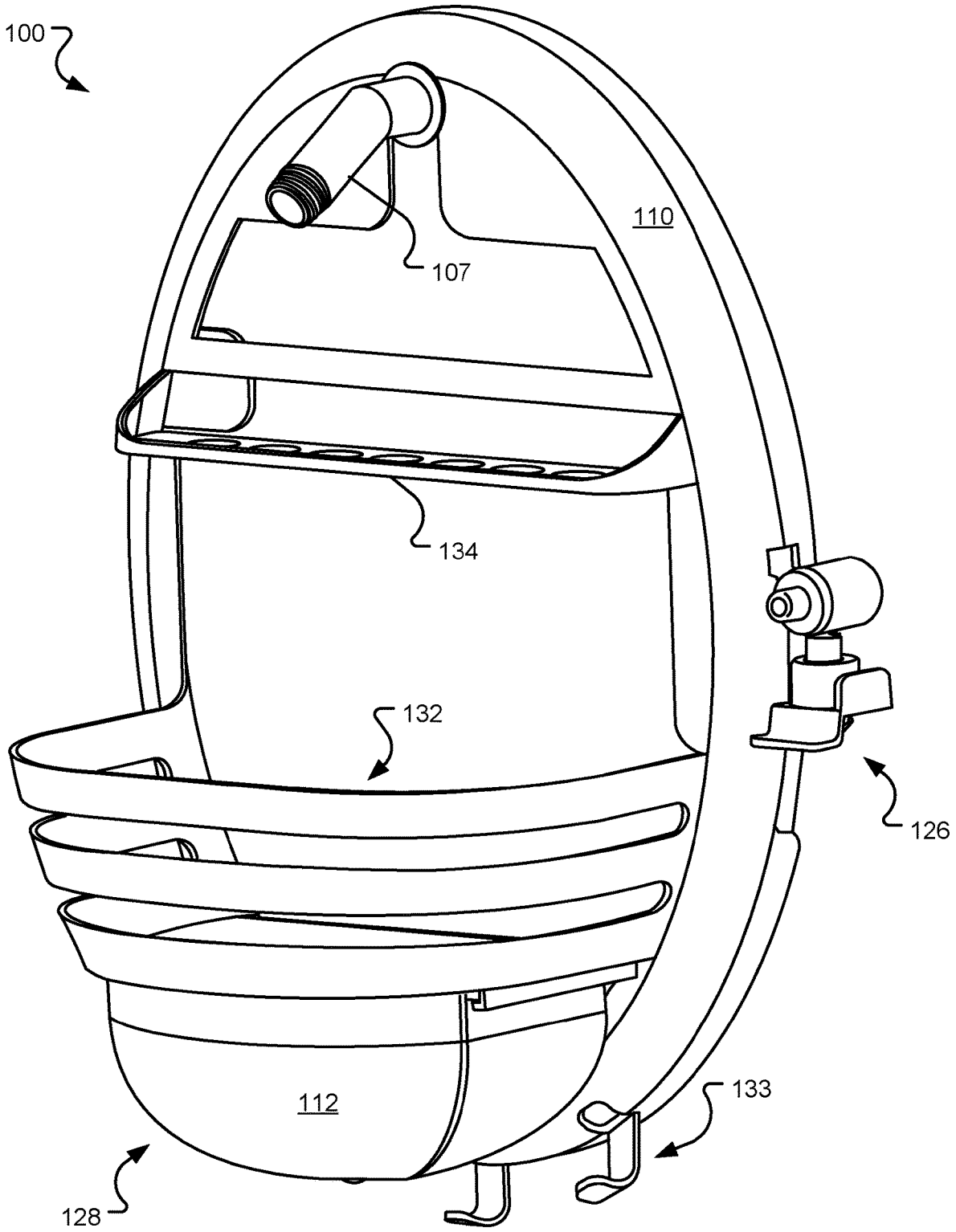
FIG. 1 illustrates a front perspective view of an example shower caddy with an additive infuser and a heated dispenser.

FIG. 1 illustrates a front perspective view of an example shower caddy 100 with an additive infuser 126 and a heated dispenser 128. The caddy 100 is intended to be used as an accessory for a user's shower. The caddy 100 includes a frame 110 that forms the physical supporting structure for functional components of the caddy 100. The frame 110 is generally a closed loop (here, an oval, but other shapes are contemplated) or a flat box or panel to conceal portions of a circuit of pipes (not shown, see e.g., pipes 808, 824 of FIG. 8) and a 4-way diverter (also not shown, see e.g., 4-way diverter 204 of FIG. 2). The frame 110 may also include additional stiffening features to achieve the desired strength (e.g., gussets) and/or concealing features to conceal portions of the caddy 100 that are not intended to be seen or manipulated by the user. The frame 110 may further include optional accessory storage features (e.g., a storage basket 132, storage hooks 133, and a shelf 134). In some implementations, the shelf 134 includes apertures (see e.g., aperture 235 of FIG. 2) for storing extra additive fluid pods (not shown, see e.g., additive fluid pod 586 of FIG. 5).

Figure 8:
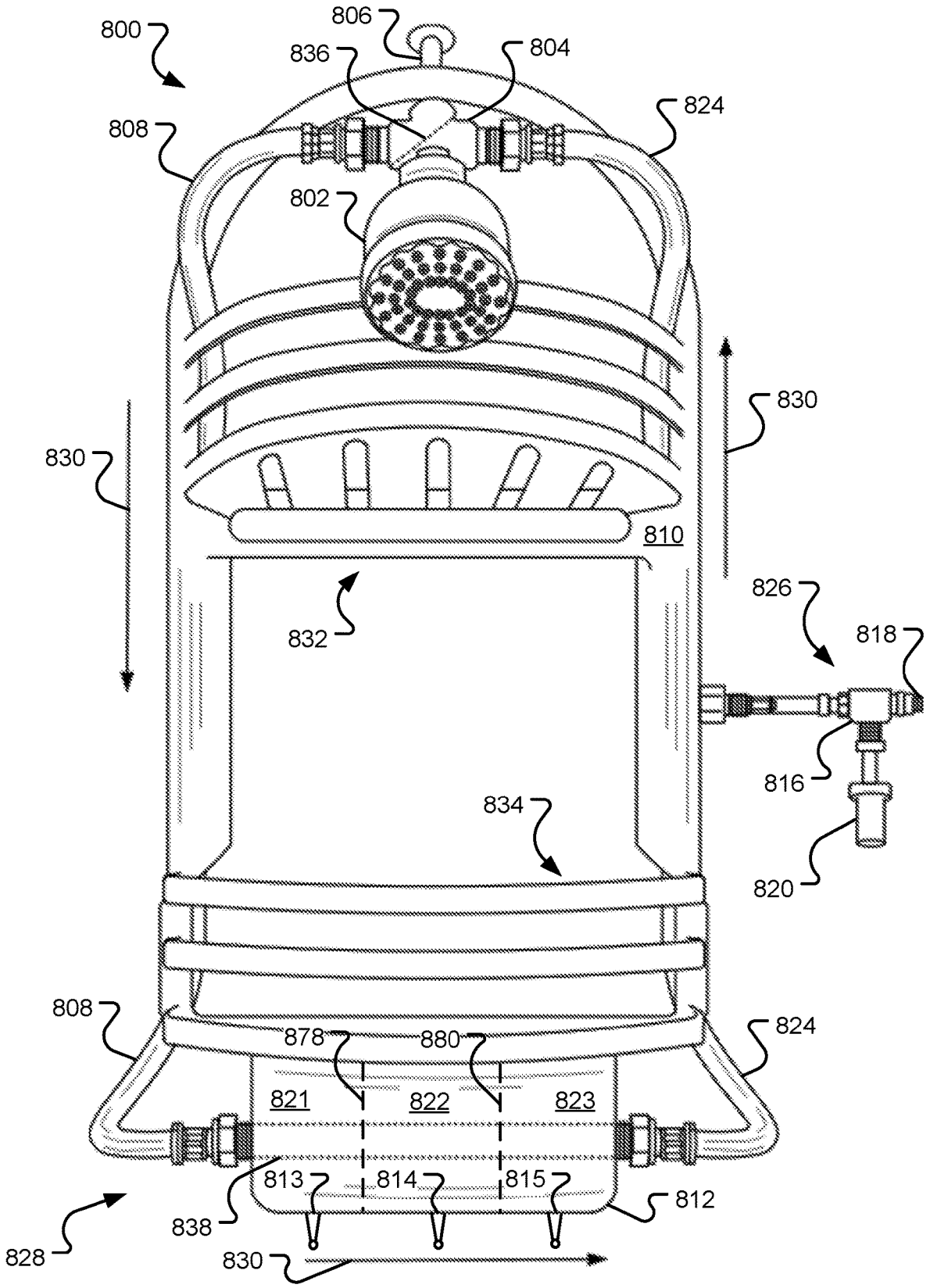
FIG. 8 illustrates an elevation view of another example shower caddy with an additive infuser and a heated dispenser.

The caddy 100 is secured to a shower wall (also not shown) by screwing or otherwise attaching the 4-way diverter to a shower arm (not shown see e.g., shower arm 806 of FIG. 8). The caddy 100 then hangs from the shower arm. The frame 110 may also be used to mount the caddy 100 to the shower wall to supplement the connection to the shower arm. For example, the frame 110 may be equipped with suction cups, magnets, or other fasteners that adhere or screw into the shower wall. The frame 110 mounting hardware may secure the caddy 100 against the wall in a manner that prevents the caddy 100 from sliding down the wall due to its weight and/or moving away from the wall during normal use.

A first input (not shown, see e.g., first input 244 of FIG. 2) of the 4-way diverter is secured and fluidly connected to the shower arm, as discussed above. The shower arm serves as an input for heated potable water into the user's shower. A first output (not shown, see e.g., first output 248 of FIG. 2) of the 4-way diverter directs the heated potable water through the circuit of pipes hidden behind the frame 110. The circuit of pipes forms a loop that returns the heated potable water to the 4-way diverter at a second input (not shown, see e.g., second input 250 of FIG. 2). A second output (not shown, see second output 264 of FIG. 2) of the 4-way diverter is attached to a caddy shower arm 107, to which a showerhead (not shown, see e.g., showerhead 802 of FIG. 8) is attached (e.g., screwed on) and fluidly connected. The end result is that the caddy 100 is fluidly located between the shower arm and the showerhead in a typical shower.

The heated dispenser 128 includes a basin 112 that stores a quantity of bathing fluid. In various implementations, the bathing fluid is an oil, scrub, soap, shampoo, conditioner, or lotion, for example. In some implementations, the bathing fluid is solid or semi-solid at room temperature (e.g., between 20 and 22 degrees Celsius) and liquid at elevated temperatures (e.g., an expected temperature of the heated potable water, or above 40 degrees Celsius). In other implementations, the bathing fluid remains liquid at all expected temperatures, but becomes less viscous and more pleasant to use at elevated temperatures (i.e., temperatures exceeding room temperature).

The basin 112 may optionally include a lid (not shown, see e.g., lid 582 of FIG. 5) that permits a user to fill the basin 112 with the bathing fluid and then close the lid to prevent contamination, dilution, or significant evaporation of the bathing fluid. The basin 112 may also optionally include a discharge valve with an actuator (not shown, see e.g., discharge valves 813, 814, 815 of FIG. 8) that permits a user to selectively discharge a desired quantity of the bathing fluid from the basin 112. In other implementations, the basin 112 may omit the lid and is open at the top for both adding bathing fluid to the basin 112 and/or removing bathing fluid from the basin 112 using a user's hands and fingers. Further, the basin 112 may be fixedly attached to or removable from the frame 110.

In some implementations, the basin 112 may include one or more internal dividers (not shown, see e.g., internal dividers 878, 880 of FIG. 8) that define two or more separate internal compartments (not shown, see e.g., internal compartments 821, 822, 823 of FIG. 8) within the basin 112. The separate internal compartments permit the basin 112 to store multiple distinct bathing fluids. Further, the basin 112 may include multiple discharge valves with associated actuators, one for each internal compartment of the basin 112.

The circuit of pipes includes a heating circuit (not shown, see e.g., heating circuit 838 of FIG. 8) that extends through the basin 112. Thermal energy from the heating circuit is conductively transferred from the heating circuit to the bathing fluid to warm the bathing fluid. The warming action may liquefy previously solid or semi-solid bathing fluid, it may decrease viscosity of the bathing fluid thereby making it easier to dispense, or it may merely warm the bathing fluid to make it more pleasant for the user. As the heating circuit utilizes all or a portion of the heated potable water flowing through the circuit of pipes, the heating circuit is able to continuously heat the bathing fluid so long as the heated potable water flows.

The additive infuser 126 is used to selectively release additive fluid into the heated potable water flowing through the circuit of pipes. The additive fluid enhances the olfactory and/or tactile sensation of the heated potable water on the user when exiting the caddy 100. Additional details regarding the additive infuser 126 are discussed below, particularly with reference to FIGS. 6 and 7.

Various components (e.g., frames, 4-way diverters, circuits of piping, associated fittings, heating circuits, heated dispensers, additive infusers, and so on) of the caddies disclosed herein (e.g., caddy 100) may be made of a variety of available materials (e.g., plastic (acrylonitrile butadiene styrene (ABS), polyvinyl chloride (PVC), nylon, synthetic rubber, etc.), natural rubber, metal (iron, steel, aluminum, stainless steel, various other alloys, etc.), or composites (e.g., chromed plastic, braided hose, etc.).

Figure 2:
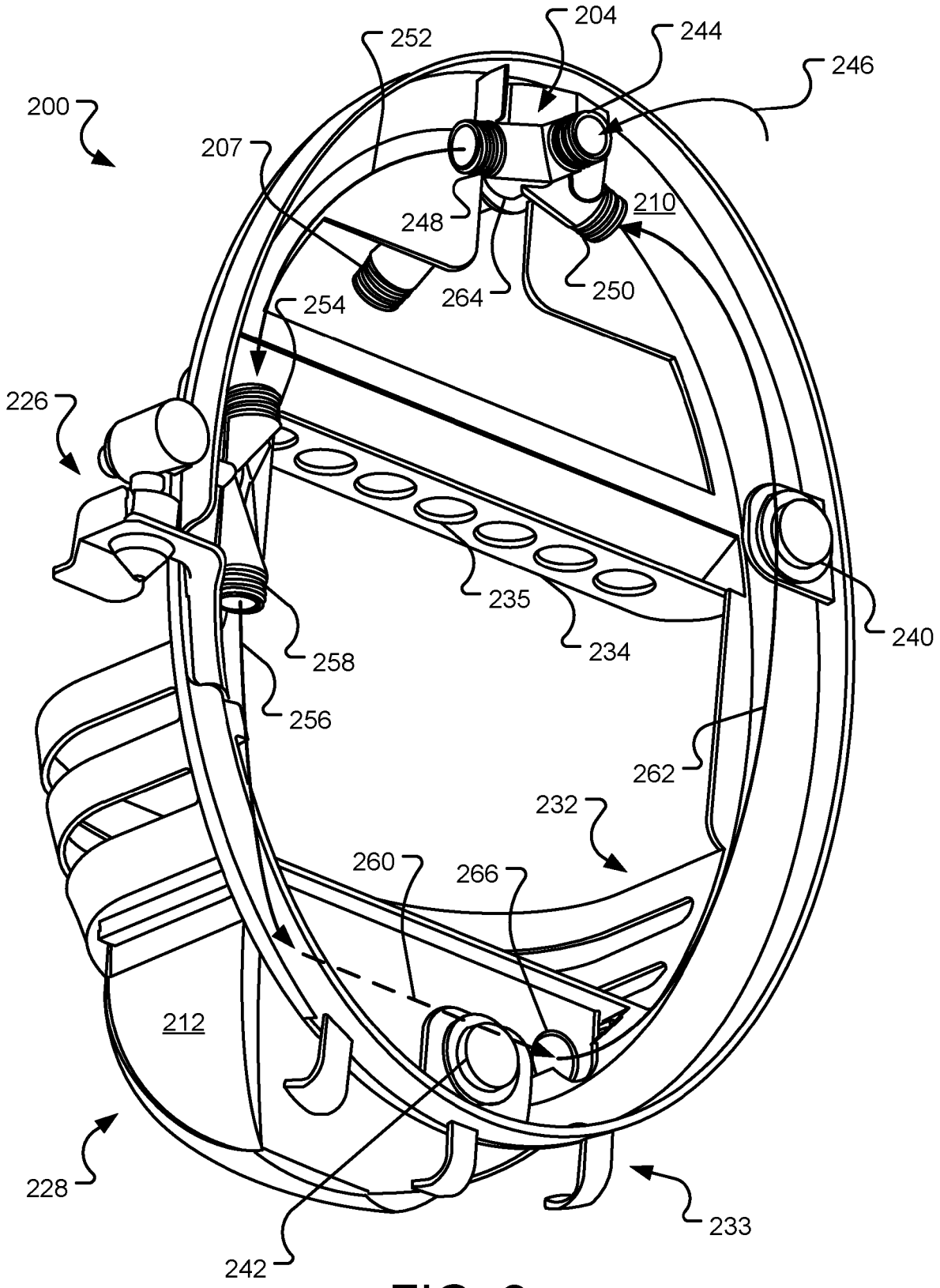
FIG. 2 illustrates a rear perspective view of an example shower caddy with an additive infuser and a heated dispenser.

FIG. 2 illustrates a rear perspective view of an example shower caddy 200 with an additive infuser 226 and a heated dispenser 228. The caddy 200 includes a frame 210 that forms the physical supporting structure for functional components of the caddy 200. The frame 210 is generally a closed loop to conceal portions of a circuit of pipes (not shown, illustrated by arrows 252, 256, 262) and a 4-way diverter 204. The frame 210 may also include additional stiffening features to achieve the desired strength and/or concealing features to conceal portions of the caddy 200 that are not intended to be seen or manipulated by the user. The frame 210 may further include optional accessory storage features (e.g., a storage basket 232, storage hooks 233, and a shelf 234). In some implementations, the shelf 234 includes apertures (e.g., aperture 235) for storing extra additive fluid pods (not shown, see e.g., additive fluid pod 586 of FIG. 5).

The caddy 200 is secured to a shower wall (also not shown) by screwing or otherwise attaching the 4-way diverter 204 to a shower arm (not shown see e.g., shower arm 806 of FIG. 8). The caddy 200 then hangs from the shower arm. The frame 210 may also be used to mount the caddy 200 to the shower wall to supplement the connection to the shower arm. For example, the frame 210 may including mounting pads 240, 242, that may be equipped with suction cups, magnets, or other fasteners that adhere or screw into the shower wall. The frame 210 mounting hardware may secure the caddy 200 against the shower wall in a manner that prevents the caddy 200 from sliding down the shower wall due to its weight and/or moving away from the shower wall during normal use.

A first input 244 of the 4-way diverter 204 is secured and fluidly connected to the shower arm, as discussed above. The shower arm serves as an input for heated potable water into the user's shower, as illustrated by arrow 246. A first output 248 of the 4-way diverter 204 directs the heated potable water through the circuit of pipes hidden behind the frame 210. The circuit of pipes forms a loop that returns the heated potable water to the 4-way diverter 204 at a second input 250.

More specifically, arrow 252 represents a section of pipe connecting the first output 248 of the 4-way diverter 204 to an input 254 of the additive infuser 226. Arrow 256 represents a section of pipe connecting an output 258 of the additive infuser 226 to an input of a heating circuit (not shown, illustrated by dashed (hidden) arrow 260) extending through basin 212 of the heated dispenser 228. Arrow 262 represents a section of pipe connecting an output of the heating circuit back to the second input 250 of the 4-way diverter 204. Thus, the circuit of pipes creates a fluid loop between the first output 248 and the second input 250 of the 4-way diverter 204. The sections of pipe represented by arrows 252, 256, and 262 are any hollow fluid conveyance of any cross-sectional shape made of any suitable material. A second output 264 of the 4-way diverter is attached to a caddy shower arm 207, to which a showerhead (not shown, see e.g., showerhead 802 of FIG. 8) is attached and fluidly connected. The end result is that the caddy 200 is fluidly located between the shower arm and the showerhead in a typical shower.

The basin 212 stores a quantity of bathing fluid, which is described in detail with reference to FIG. 1. The basin 212 may optionally include a lid (not shown, see e.g., lid 582 of FIG. 5) that permits a user to fill the basin 212 with the bathing fluid and then close the lid to prevent contamination, dilution, or significant evaporation of the bathing fluid. The basin 212 may also optionally include a discharge valve with an actuator (not shown, see e.g., discharge valves 813, 814, 815 of FIG. 8) that permits a user to selectively discharge a desired quantity of the bathing fluid from the basin 212. In other implementations, the basin 212 may omit the lid and is open at the top for both adding bathing fluid to the basin 212 and/or removing bathing fluid from the basin 212 using a user's hands and fingers. Further, the basin 212 may be fixedly attached to or removable from the frame 210.

In some implementations, the basin 212 may include one or more internal dividers (not shown, see e.g., internal dividers 878, 880 of FIG. 8) that define two or more separate internal compartments (not shown, see e.g., internal compartments 821, 822, 823 of FIG. 8) within the basin 212. The separate internal compartments permit the basin 212 to store multiple distinct bathing fluids. Further, the basin 212 may include multiple discharge valves with associated actuators, one for each internal compartment.

The circuit of pipes are connected to the heating circuit (not shown, see e.g., heating circuit 838 of FIG. 8), which is an additional pipe or network of pipes extending through the basin 112, as illustrated by the dashed arrow 260. More specifically, the heating circuit is fluidly in-line with the circuit of pipes and thus flows the heated potable water therethrough. In one implementation, the heating circuit enters the basin 212 through a first aperture (not shown) on one end of the basin 212 and exits the basin 212 through a second aperture 266 on a second end of the basin 212. In other implementations, the heating circuit both enters and exits the basin 212 via the aperture 266 as the aperture 266 is sufficiently large to accommodate both incoming and outgoing portions of the heating circuit.

In one implementation, the heating circuit is a singular pipe extending through the basin 212. In other implementations, the heating circuit may branch out to a network or manifold of pipes in increase surface area for conductive heat transfer. Still further, the basin 212 may be double-walled and the heating circuit may extend between the walls of the basin 212. In some implementations, the heating circuit is made of a material with a particularly high thermal conductivity (e.g., a copper alloy), which may be distinct from the material construction of some or all of the remainder of the circuit of pipes (e.g., plastic). Thermal energy from the heating circuit is conductively transferred from the heating circuit to the bathing fluid to warm the bathing fluid. As the heating circuit utilizes all or a portion of the heated potable water flowing through the circuit of pipes, the heating circuit is able to continuously heat the bathing fluid so long as the heated potable water flows.

The additive infuser 226 is used to selectively release additive fluid into the heated potable water flowing through the circuit of pipes. The additive fluid enhances the olfactory and/or tactile sensation of the heated potable water when exiting the caddy 200. Additional details regarding the additive infuser 226 are discussed below, particularly with reference to FIGS. 6 and 7.

Figure 3:
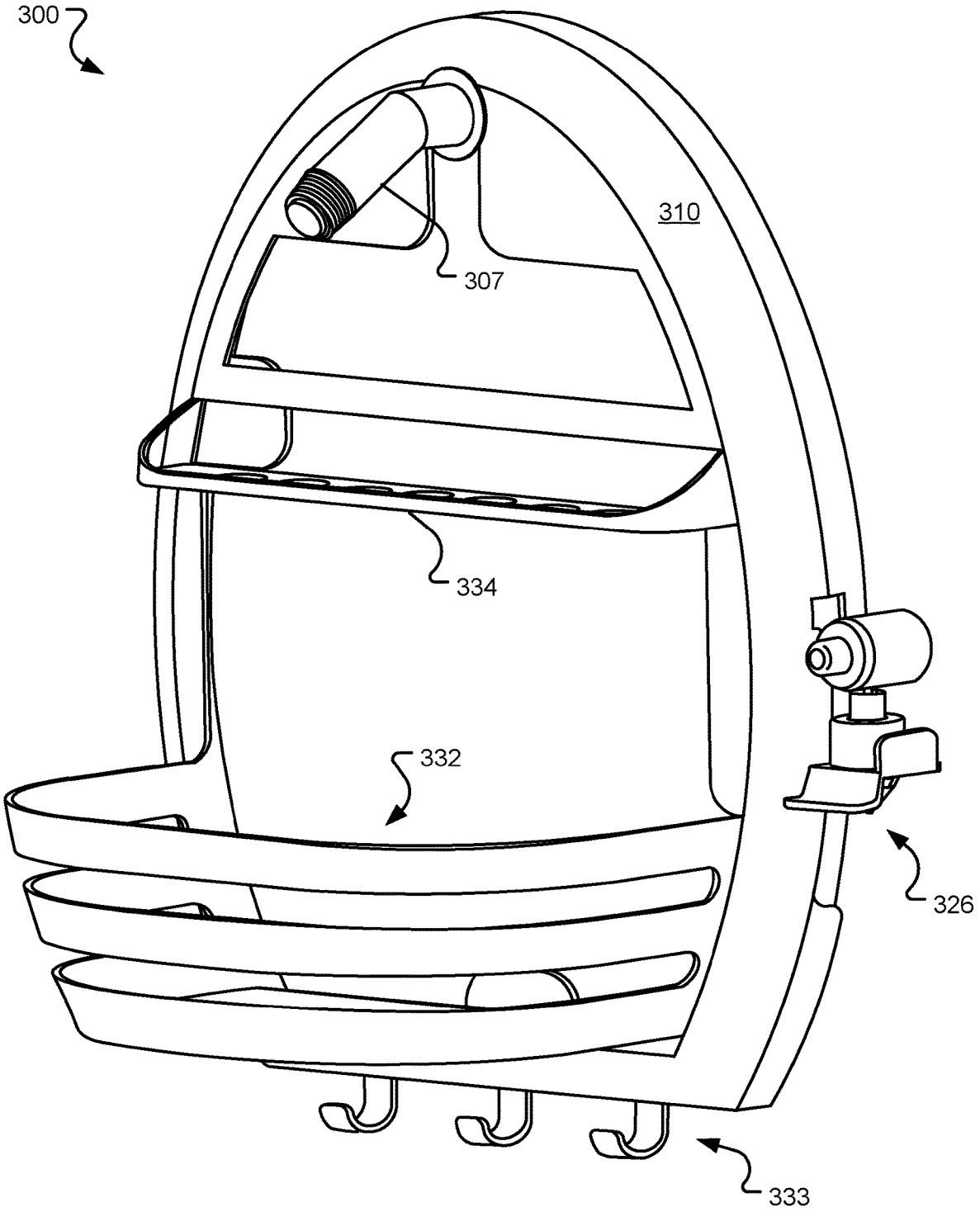
FIG. 3 illustrates a front perspective view of an example shower caddy with an additive infuser.

FIG. 3 illustrates a front perspective view of an example shower caddy 300 with an additive infuser 326. The caddy 300 includes a frame 310 that forms the physical supporting structure for functional components of the caddy 300. The frame 310 is generally a closed loop to conceal portions of a circuit of pipes (not shown, see e.g., pipes 808, 824 of FIG. 8) and a 4-way diverter (also not shown, see e.g., 4-way diverter 404 of FIG. 4). The frame 310 may also include additional stiffening features to achieve the desired strength and/or concealing features to conceal portions of the caddy 300 that are not intended to be seen or manipulated by the user. The frame 310 may further include optional accessory storage features (e.g., a storage basket 332, storage hooks 333, and a shelf 334).

The caddy 300 is secured to a shower wall (also not shown) by screwing or otherwise attaching the 4-way diverter to a shower arm (not shown see e.g., shower arm 806 of FIG. 8). The caddy 300 then hangs from the shower arm. The frame 310 may also be used to mount the caddy 300 to the shower wall to supplement the connection to the shower arm. For example, the frame 310 may be equipped with suction cups, magnets, or other fasteners that adhere or screw into the shower wall. The frame 310 mounting hardware may secure the caddy 300 against the wall in a manner that prevents the caddy 300 from sliding down the wall due to its weight and/or moving away from the wall during normal use.

A first input (not shown, see e.g., first input 444 of FIG. 4) of the 4-way diverter is secured and fluidly connected to the shower arm, as discussed above. The shower arm serves as an input for heated potable water into the user's shower. A first output (not shown, see e.g., first output 448 of FIG. 4) of the 4-way diverter directs the heated potable water through the circuit of pipes hidden behind the frame 310. The circuit of pipes forms a loop that returns the heated potable water to the 4-way diverter at a second input (not shown, see e.g., second input 450 of FIG. 4). A second output (not shown, see e.g., second output 464 of FIG. 4) of the 4-way diverter is attached to a caddy shower arm 307, to which a showerhead (not shown, see e.g., showerhead 802 of FIG. 8) is attached and fluidly connected. The end result is that the caddy 300 is fluidly located between the shower arm and the showerhead in a typical shower.

The additive infuser 326 is used to selectively release additive fluid into the heated potable water flowing through the circuit of pipes. The additive fluid enhances the olfactory and/or tactile sensation of the heated potable water on the user when exiting the caddy 300. Additional details regarding the additive infuser 326 are discussed below, particularly with reference to FIGS. 6 and 7.

Figure 4:
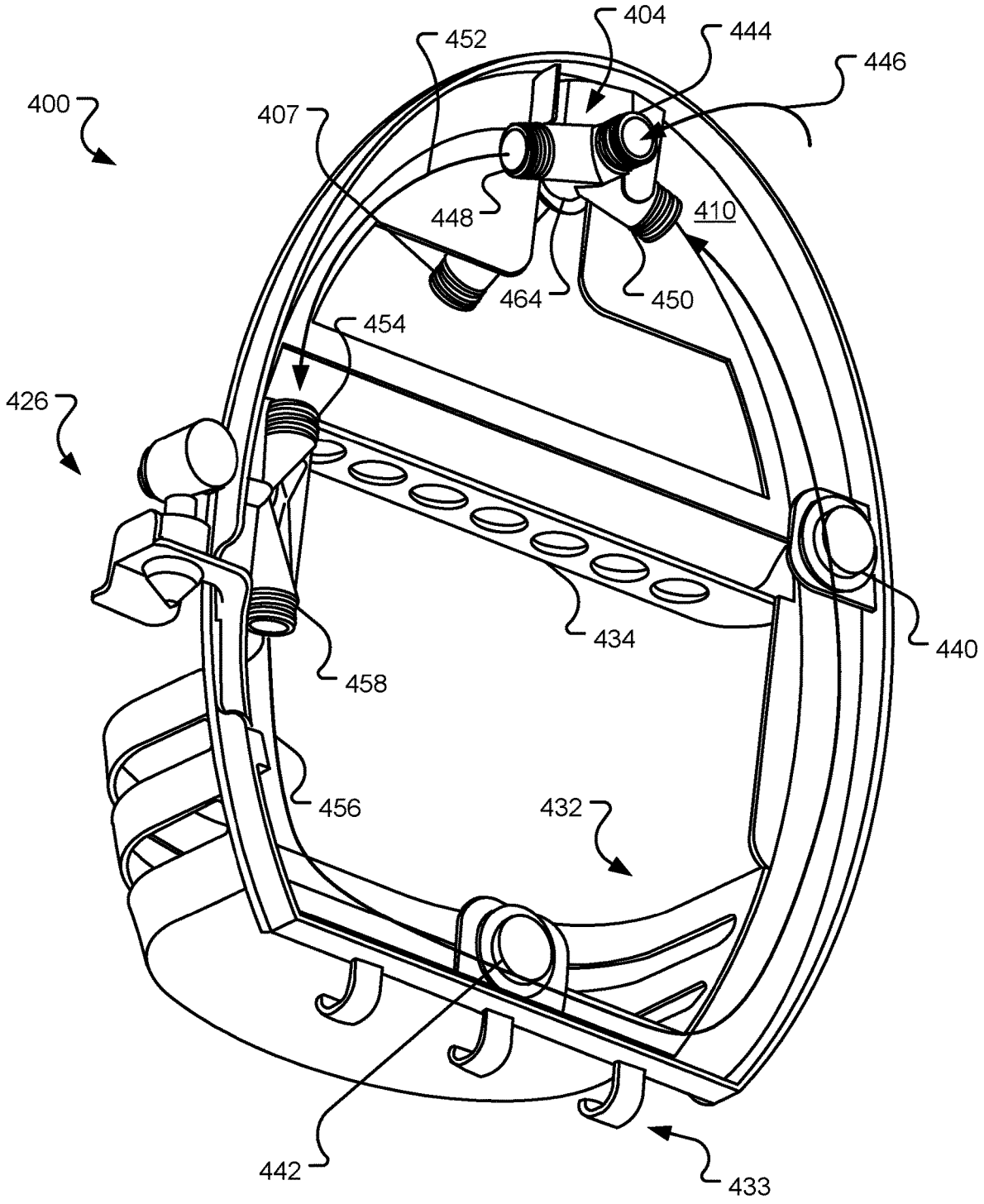
FIG. 4 illustrates a rear perspective view of an example shower caddy with an additive infuser.

FIG. 4 illustrates a rear perspective view of an example shower caddy 400 with an additive infuser 426. The caddy 400 includes a frame 410 that forms the physical supporting structure for functional components of the caddy 400. The frame 410 is generally a closed loop to conceal portions of a circuit of pipes (not shown, illustrated by arrows 452, 456) and a 4-way diverter 404. The frame 410 may also include additional stiffening features to achieve the desired strength and/or concealing features to conceal portions of the caddy 400 that are not intended to be seen or manipulated by the user. The frame 410 may further include optional accessory storage features (e.g., a storage basket 432, storage hooks 433, and a shelf 434).

The caddy 400 is secured to a shower wall (also not shown) by screwing or otherwise attaching the 4-way diverter 404 to a shower arm (not shown, see e.g., shower arm 806 of FIG. 8). The caddy 400 then hangs from the shower arm. The frame 410 may also be used to mount the caddy 400 to the shower wall to supplement the connection to the shower arm. For example, the frame 410 may include mounting pads 440, 442, that may be equipped with suction cups, magnets, or other fasteners that adhere or screw into the shower wall. The frame 410 mounting hardware may secure the caddy 400 against the shower wall in a manner that prevents the caddy 400 from sliding down the shower wall due to its weight and/or moving away from the shower wall during normal use.

A first input 444 of the 4-way diverter 404 is secured and fluidly connected to the shower arm, as discussed above. The shower arm serves as an input for heated potable water into the user's shower, as illustrated by arrow 446. A first output 448 of the 4-way diverter 404 directs the heated potable water through the circuit of pipes hidden behind the frame 410. The circuit of pipes forms a loop that returns the heated potable water to the 4-way diverter 404 at a second input 450.

More specifically, arrow 452 represents a section of pipe connecting the first output 448 of the 4-way diverter 404 to an input 454 of the additive infuser 426. Arrow 456 represents a section of pipe connecting an output 458 of the additive infuser 426 back to the second input 450 of the 4-way diverter 404. Thus, the circuit of pipes creates a fluid loop between the first output 448 and the second input 450 of the 4-way diverter 404. The sections of pipe represented by arrows 452, 456 are any hollow fluid conveyance of any cross-sectional shape made of any suitable material. A second output 464 of the 4-way diverter is attached to a caddy shower arm 407, to which a showerhead (not shown, see e.g., showerhead 802 of FIG. 8) is attached and fluidly connected. The end result is that the caddy 400 is fluidly located between the shower arm and the showerhead in a typical shower.

The additive infuser 426 is used to selectively release additive fluid into the heated potable water flowing through the circuit of pipes. The additive fluid enhances the olfactory and/or tactile sensation of the heated potable water when exiting the caddy 400. Additional details regarding the additive infuser 426 are discussed below, particularly with reference to FIGS. 6 and 7.

Figure 5:
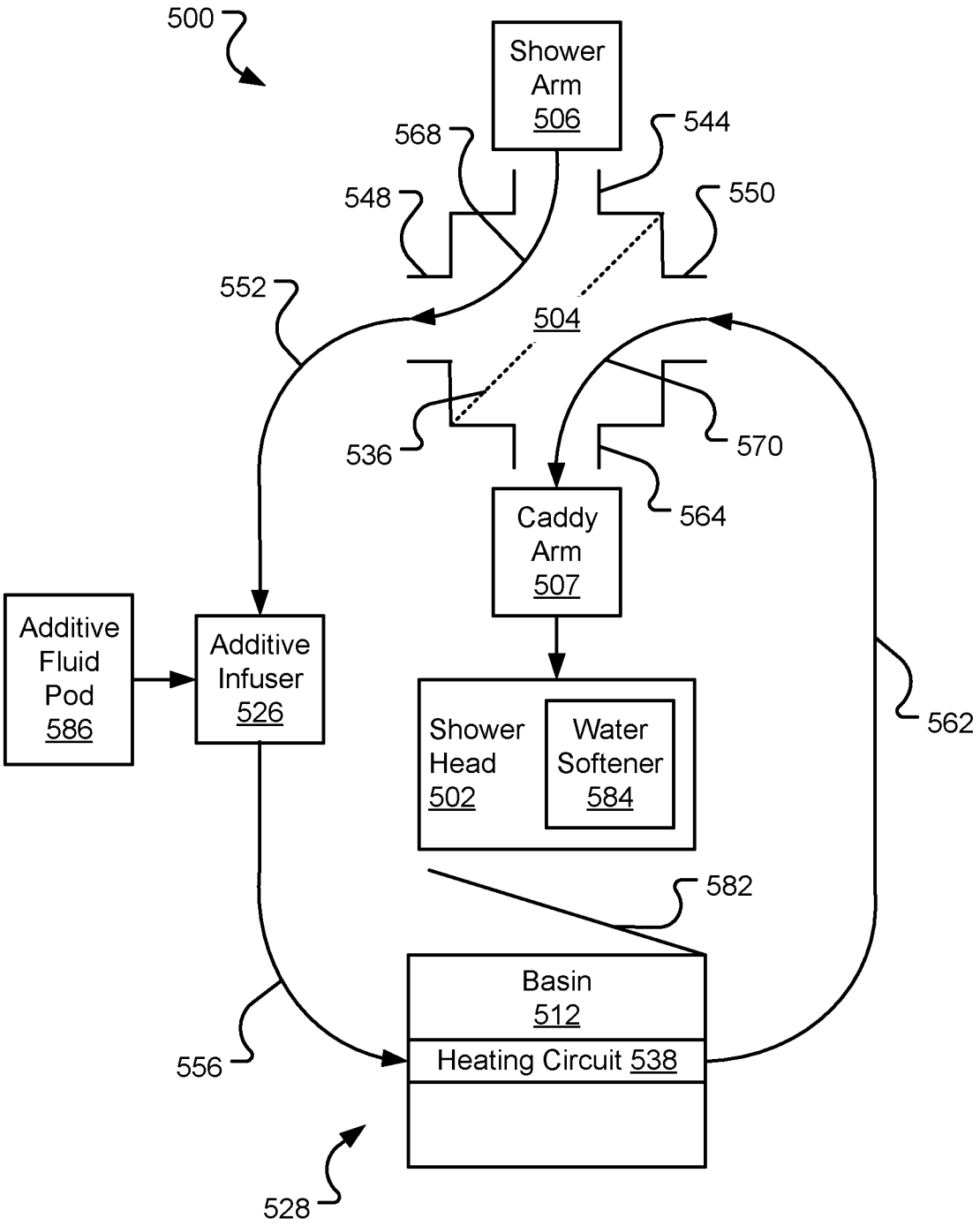
FIG. 5 illustrates an example flow diagram for an example shower caddy with one or both of an additive infuser and a heated dispenser.

FIG. 5 illustrates an example flow diagram for an example shower caddy 500 with one or both of an additive infuser 526 and a heated dispenser 528. The caddy 500 includes a 4-way diverter 504, which itself includes a pair of input ports 544, 550 and a pair of output ports 548, 564. The 4-way diverter 504 also includes an internal physical divider 536 that separates a first fluid path running from input 544 to output 548 from a second fluid path running from input 550 to output 564. As a result, the 4-way diverter 504 permits exclusively the fluid paths illustrated by arrows 568, 570 therethrough.

The first input 544 of the 4-way diverter 504 is secured and fluidly connected to shower arm 506. The shower arm 506 serves as an input for heated potable water into the user's shower. The first output 548 of the 4-way diverter 504 directs the heated potable water through a circuit of pipes. The circuit of pipes forms a loop that returns the heated potable water to the 4-way diverter 504 at the second input 550.

More specifically, arrow 552 represents a section of pipe connecting the first output 548 of the 4-way diverter 504 to an input of the additive infuser 526. Arrow 556 represents a section of pipe connecting an output of the additive infuser 526 to an input of a heating circuit 538, which extends through basin 512 of the heated dispenser 528. In various implementations, the basin 512 may include a lid 582 that may be selectively opened for adding and/or removing bathing fluid to and/or from the basin 512. Arrow 562 represents a section of pipe connecting an output of the heating circuit 538 back to the second input 550 of the 4-way diverter 504. Thus, the circuit of pipes creates a fluid loop between the first output 548 and the second input 550 of the 4-way diverter 504. The sections of pipe represented by arrows 552, 556, and 562 are any hollow fluid conveyance of any cross-sectional shape made of any suitable material.

In some implementations, the additive infuser 526 includes a reservoir (not shown, see e.g., reservoir 620 of FIG. 6) that stores additive fluid for the additive infuser. In other implementations, the additive infuser 526 includes a seat for a replaceable additive infuser pod 586 that permits a user to easily replace the additive infuser pod 586 when it is spent, or swap the additive infuser pod 586 for another when the user desires a different olfactory and/or tactile sensation of the heated potable water. In various implementations, the additive infuser pod 586 includes a resealable cap or rubber diaphragm with a self-closing pinhole that enables it to be reused even after only being partially discharged or be refilled. In still further implementations, the additive infuser 526 may have multiple redundant seats for multiple additive infuser pods and redundant user selectors and valve assemblies (not shown, see e.g., valve assembly 616 and user selector 618 of FIG. 6) so that the additive infuser 526 may selectively discharge different additive fluids that meet the user's desired olfactory and/or tactile sensations, without swapping the additive infuser pods out.

A second output 564 of the 4-way diverter is attached to a caddy shower arm 507, to which a showerhead 502 is attached and fluidly connected. The end result is that the caddy 500 is fluidly located between the shower arm 506 and the showerhead 502 in a typical shower. In some implementations, the showerhead 502 incorporates an integrated water softener 584, as shown. The water softener 584 may continuously or selectively soften particularly hard heated potable water prior to use. In other implementations, the water softener 584 may be oriented at any other point along the circuit of pipes of the caddy 500.

Figure 6:
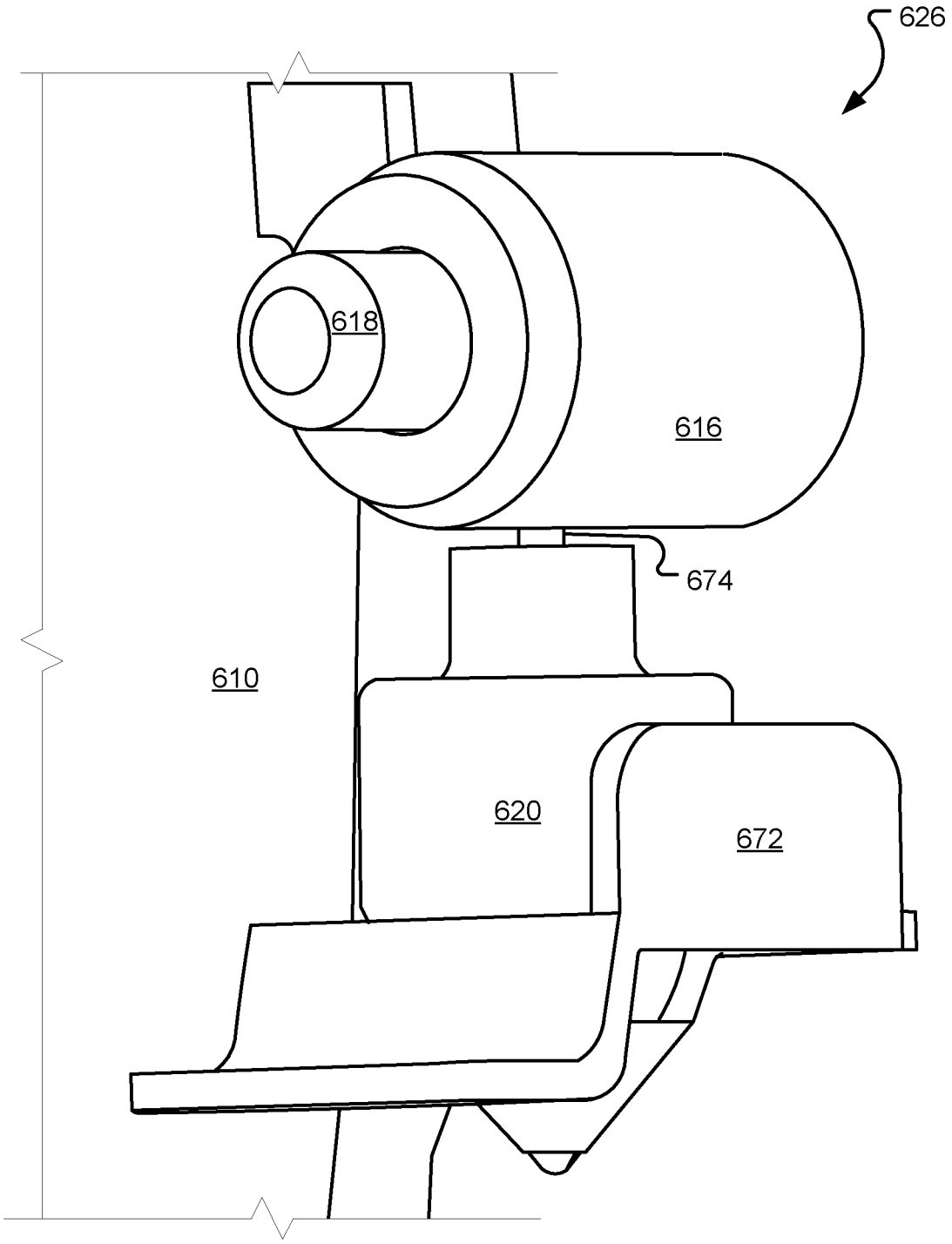
FIG. 6 illustrates a first perspective detail view of an example additive infuser for a shower caddy.

FIG. 6 illustrates a first perspective detail view of an example additive infuser 626 for a shower caddy. The additive infuser 626 is used to selectively release (or introduce) additive fluid into the heated potable water flowing through the circuit of pipes. The additive fluid enhances the olfactory and/or tactile sensation of the heated potable water on the user when exiting the caddy. Bracket 672 extends from caddy frame 610 and serves as a mounting structure for the additive infuser 626. The frame 610 forms the physical supporting structure for functional components of the caddy, including the additive infuser 626.

The additive infuser 626 includes a reservoir 620 that stores a quantity of the additive fluid. The additive fluid may be any fluid that adds an olfactory and/or tactile sensation to the heated potable water, including but not limited to essential oils, distillates, fragrances, perfumes, extracts, and so on. A valve assembly 616 is attached to the reservoir 620, including a straw 674 extending into the reservoir 620 and serving as an input to the valve assembly 616. The straw 674 may extend nearly to the bottom of the interior of the reservoir 620. Further, the reservoir 620 may be attached to the straw 674 via a friction fit, but other mechanisms for attachment are contemplated. A user selector 618 (e.g., a button) is attached to the valve assembly 616 and enables a user of the additive infuser 626 to selectively open the valve assembly 616 to infuse the heated potable water flowing through the circuit of pipes with the additive fluid.

In some implementations, the valve assembly 616 is configured to meter a specific quantity of additive fluid from the reservoir 620 over a preselected period of time (or release period) into the heated potable water regardless of duration or number of selections of the user selector 618. This prevents a user from over using the additive fluid and perhaps draining the reservoir 620 too quickly. For example, the valve assembly 616 may meter the additive fluid from the reservoir 620 over the next 5 minutes at a predetermined rate regardless of the number of time or duration of selections of the user selector 618 during that 5 minutes. In some implementations, selection of the user selector 618 a second time during the release period may increase the rate of discharge of the additive fluid from the reservoir 620, but any further selections will have no effect. While 5 minutes is given as an example release period, other timeframes for the release period are contemplated.

An output from the valve assembly 616 extends to a venturi injector (not shown, see e.g., venturi injector 776 of FIG. 7) that lies in line with the heated potable water flowing through the circuit of pipes. Upon opening the valve assembly 616, a venturi effect applies a negative gauge pressure to the straw 674, sucking and metering the additive fluid into the heated potable water flowing through the circuit of pipes.

In other implementations, the venturi injector is omitted and the user selector 618 functions as a manual pump to pressurize the reservoir 620 (or directly pump the additive fluid) thus discharging the additive fluid into the heated potable water flowing through the circuit of pipes. In still other implementations, the venturi injector is also omitted and the user selector 618 actuates a pump (e.g., an electrically driven pump, or a pump driven by the water flowing through the circuit of pipes), which in turn pumps the additive fluid into the heated potable water flowing through the circuit of pipes.

Figure 7:
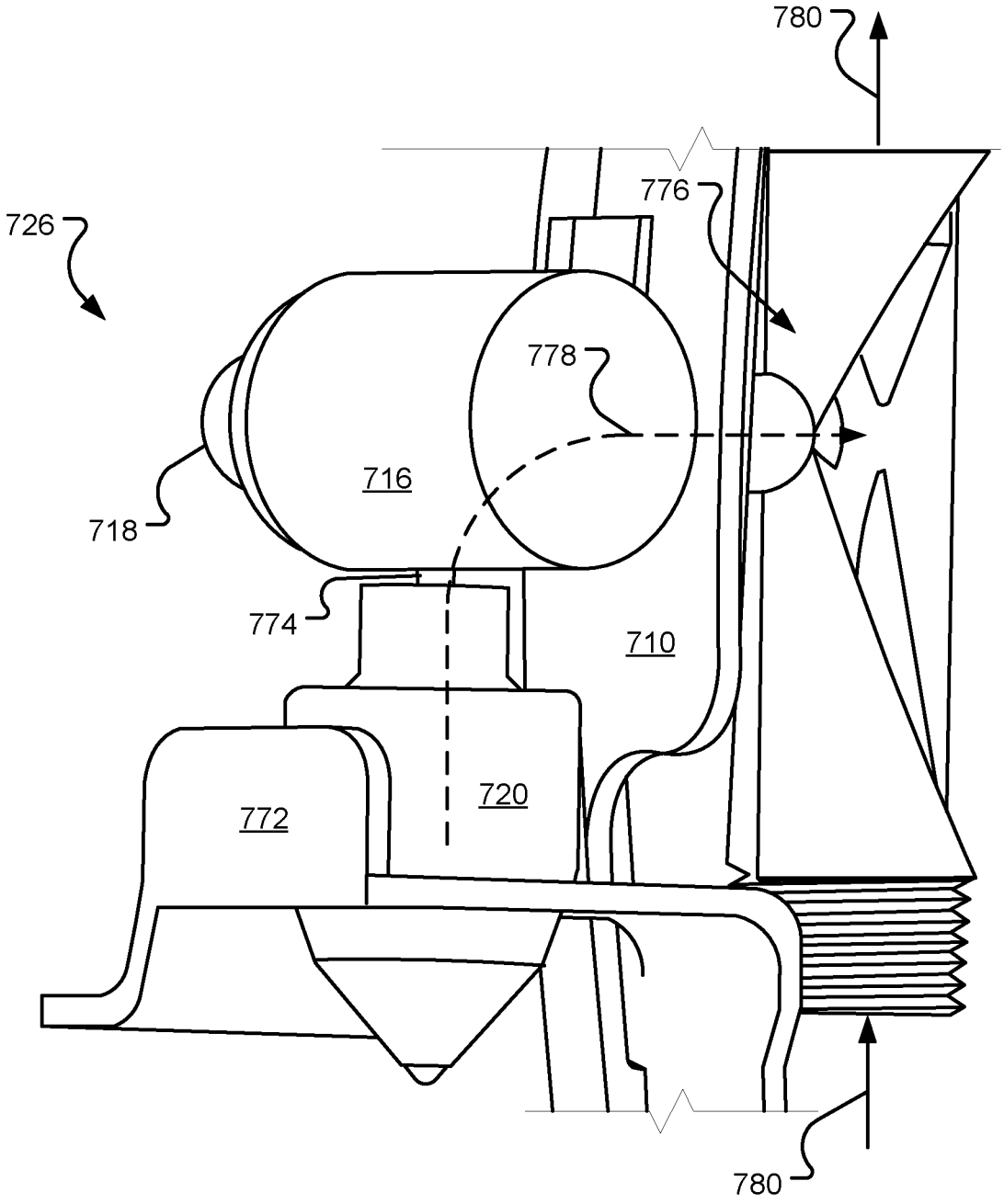
FIG. 7 illustrates a second perspective detail view of an example additive infuser for a shower caddy.

FIG. 7 illustrates a second perspective detail view of an example additive infuser 726 for a shower caddy. The additive infuser 726 is used to selectively release additive fluid into the heated potable water flowing through the circuit of pipes. The flow of the heated potable water through the circuit of pipes is illustrated by arrows 780 of FIG. 7. The additive fluid enhances the olfactory and/or tactile sensation of the heated potable water on the user when exiting the caddy. Bracket 772 extends from caddy frame 710 and serves as a mounting structure for the additive infuser 726. The frame 710 forms the physical supporting structure for functional components of the caddy, including the additive infuser 726.

The additive infuser 726 includes a reservoir 720 that stores a quantity of the additive fluid. The additive fluid may be any fluid that adds an olfactory and/or tactile sensation to the heated potable water, including but not limited to essential oils, fragrances, perfumes, extracts, and so on. A valve assembly 716 is attached to the reservoir 720, including a straw 774 extending into the reservoir 720 and serving as an input to the valve assembly 716. The straw 774 may extend nearly to the bottom of the interior of the reservoir 720. Further, the reservoir 720 may be attached to the straw 774 via a friction fit, but other mechanisms for attachment are contemplated. A user selector 718 (e.g., a button) is attached to the valve assembly 716 and enables a user of the additive infuser 726 to selectively open the valve assembly 716 to infuse the heated potable water flowing through the circuit of pipes with the additive fluid.

An output from the valve assembly 716 extends to a venturi injector 776 that lies in line with the heated potable water flowing through the circuit of pipes. Upon opening the valve assembly 716, a venturi effect applies a negative gauge pressure to the straw 774, sucking and metering the additive fluid into the heated potable water flowing through the circuit of pipes, as generally illustrated by dashed arrow 778.

In other implementations, the venturi injector 776 is omitted and the user selector 718 functions as a manual pump to pressurize the reservoir 720 (or directly pump the additive fluid) thus discharging the additive fluid into the heated potable water flowing through the circuit of pipes. In still other implementations, the venturi injector 776 is also omitted and the user selector 718 actuates a pump (e.g., an electrically driven pump, or a pump driven by the water flowing through the circuit of pipes), which in turn pumps the additive fluid into the heated potable water flowing through the circuit of pipes.

FIG. 8 illustrates an elevation view of another example shower caddy 800 with an additive (or oil) infuser 826 and a heated dispenser (or assembly) 828. The caddy 800 includes a caddy body (or frame) 810 that includes optional shelf assemblies 832, 834. The caddy body 810 is configured to be positioned on or otherwise removably connected to a shower arm 806. The shower arm 806 is removably attached (e.g., using threading or other attaching mechanisms) to a 4-way connector (or diverter) 804, which is further removably connected to a showerhead 802. The connector 804 is configured to divert received fluids, such as heated potable water, from the shower arm 806 through a fluid conveyance assembly that includes pipes 808 and 824 as well as portions of the heating assembly 828. The connector 804 may include an interior diagonal wall/divider (illustrated in dashed line 836 as it is hidden from view). The fluid conveyance assembly (i.e., pipes 808 and 824, as well as additional fittings and components) is shown including elements structurally separated from the caddy body 810, but it should be understood that the fluid conveyance assembly may be implemented as a structure built into the caddy body 810.

Fluid (or heated potable water) received from the shower arm 806 is routed through the pipe 808 via the connector 804, through the heating assembly 828, through the pipe 824, back to the connector 804, and out the showerhead 802. In other words, the fluid is routed in a counter-clockwise direction around the caddy 800 as illustrated by arrows 830. In some example implementations, the fluid may be routed in a clockwise direction. In yet other implementations, the directional flow of the water is configurable using the connector 804. For example, the connector 804 may include a directional valve to change the direction of the received fluid. In other example implementations, the connector 804 may be connected in a different position relative to the shower arm 806, the pipes 808, 824, and the showerhead 802 such as to cause the fluid to flow in a clockwise direction. The connector 804 is shown as being removably connected to the pipes 808, 824, but it should be understood that the pipes 808, 824 and the connector 804 may be integrated components. Furthermore, the connector 804 may be integrated into the caddy body 810.

Fluids are routed to the heating assembly 828 via the pipe 808. The heating assembly 828 includes a basin 812 having internal compartments 821, 822, 823 and associated dispensing mechanisms (or discharge valves) 813, 814, 815, and a heating mechanism 838 (e.g., a thermally conductive pipe). The heating mechanism 838 is illustrated in dashed lines as it is hidden from view. In some example implementations, the heating mechanism 838 is a copper pipe. In such an implementation, the heating mechanism 838 is connected between the pipes 808, 824 and through the volume of the basin 812. Materials such as coconut oil, shampoo, conditioner, soap, lotion, etc. may be deposited into the basin 812.

In other implementations, the pipes 808 and 824 are connected directly with or are contiguous through the basin 812. The materials (e.g., bathing fluids) deposited into the basin 812 may be in a solid, semisolid, or liquid state at room temperature. When the heated potable water received from the shower arm 806 passes through the heating mechanism 838, the heating mechanism 838 thermally conducts the heat from the water to the material positioned in the basin 812. Accordingly, the material is warmed and/or liquefied, which may provide an enhanced shower experience to a user. The heating mechanism 838 may be coiled or otherwise directed in a manner through the basin 812 such as to provide sufficient surface area to heat the material. It should be understood that the heating mechanism 838 may include any conductive substance that is suitable to transfer heat from flowing water. Furthermore, any shape that allows water to travel through while providing thermal conductivity may be suitable for the described implementations.

The basin 812 is illustrated with the internal compartments 821, 822, 823, separated by internal dividers 878, 880. The separate internal compartments 821, 822, 823 enable the basin 812 to store three different bathing fluids, each with an associated dispensing mechanism (or valve) 813, 814, 815. In other implementations, there are no internal dividers and merely a singular compartment within the basin 812, or there may be any other number of internal compartments within the basin 812 and associated dividers and dispensing mechanisms. The user may utilize the dispensing mechanisms 813, 814, 815 to dispense the material from the internal compartments 821, 822, 823, respectively, of the basin 812. In the illustrated implementation, the dispensing mechanisms 813, 814, 815 utilize gravity and one or more springs to dispense the materials, but it should be understood that other types of dispensing mechanisms (e.g., a pump) and discharge valves may be used to dispense materials from the basin 812. While the valves 813, 814, 815 are depicted at the bottom of the basin 812 and are a combined valve/actuator assembly, the valves 813, 814, 815 may also work in conjunction with separate actuating buttons on the basin 812. Other valve/actuator combinations are contemplated herein.

The shelf assemblies 832, 834 each include shelf rails and a shelf base. In some example implementations, the basin 812 is slidably attached to the caddy body 810. As such, a user can slide the basin 812 out to allow the user to insert materials into the basin 812. While the basin 812 is illustrated as slidably attached to the base of the shelf assembly 834, the basin 812 could be located in a different position on the caddy 800. Further, the shelf assemblies 832, 834 may be formed as a portion of the frame 810 or formed separately and then later attached to the frame 810. Further, the basin 812 may be integrated into the caddy body 810 in a fixed position. Still further, in some example implementations, the caddy 800 may include a secondary heating mechanism (not shown) below the shelf assembly 832. If two heating mechanisms are included in the caddy 800, the pipes 808, 824 may include tees (or other diversion devices) for diverting the heated potable water to each heating mechanism.

When the heated potable water leaves the heating mechanism 828, it travels back to the connector 804 via the pipe 824. The oil infuser 826 is connected to the pipe 824 between the heating mechanism 828 and the connector 804. The oil infuser 826 includes an activation apparatus (or user selector) 818 (e.g., a button) that is used to inject oil into the water/fluid stream passing through the pipe 824. The oil infuser 826 further includes an oil container (or reservoir) 820 that is removably attached to a valve assembly 816 that opens when the activation apparatus 818 is activated. In some example implementations, the oil infuser 826 further includes a venturi injector (not shown, see e.g., venturi injector 776 of FIG. 7) to introduce oil from the container 820 into the pipe 824. The water passing through the pipe 824 causes a localized drop in pressure due to the venturi effect that pulls the oil from the container 820 into the pipe 824. More specifically, the pipe 824 may include the venturi injector that constricts the diameter of the fluid/water passage to increase the fluid velocity at the point where the oil infuser 826 is attached, causing the oil to be injected into the water. Other types of devices that infuse liquid into other liquids moving through channels are contemplated herein.

The oil infuser 826 may be utilized to insert scented or therapeutic liquids/oils into the water stream before water is ejected from the showerhead 802. Because the oil container 820 is removably attached (e.g., via threaded or other friction attachment mechanisms) to the oil infuser 826, the oils may be changed or substituted depending on the desires of the user. Furthermore, because the oil infuser 826 may utilize a venturi injector, no power supply or manual pump is needed to inject the oil into the water stream. In some example implementations, the oil infuser 826 is configured such that multiple containers (e.g., the container 820) may be attached. Each container may also be attached to separate activation apparatuses (e.g., the activation apparatus 818) such that a user can selectively infuse different oils/liquids into the fluid stream.

In some example implementations, the oil infuser 826 may be selectively placed on either side of the caddy body 810. Accordingly, the caddy body 810 may include openings for attaching the oil infuser, or the pipes 808, 824 may each include an opening for attaching the oil infuser 826. Because the oil infuser 826 may be placed at a variety of locations on pipes 808, 824, the caddy 800 may be placed in tight spaces, while still permitting the user access to the oil infuser 826. Further, the fluid components (e.g., the pipes 808, 824, the basin 812, and the oil infuser 826) may be formed into the structural components of a building shower. For example, a hotel may build the pipes 808, 824, portions of the heating assembly 828, and/or portions of the oil infuser 826 behind a tiled wall. The visible components (to the user) may include the activation apparatus 818, the dispensing mechanism 814, and the showerhead 802, for example The caddy 800 may be formed of materials such as engineered, printed, or molded plastics, stainless steel, etc. The pipes 808, 824 may be flexible braided lines or stiff pipes formed of PVC, stainless steel, or other materials. The pipes 808, 824, which form the water conveyance system, may be built into the structural components of the caddy 800. As noted above, the thermally conductive surface(s) of the heating mechanism 838 may be a copper, nickel, or other metal or metal alloy pipe. Other thermally conductive materials are contemplated as well. The basin 812 may be formed of an insulating material and the caddy frame 810 may be constructed of metal and/or plastic via molding, printing, forming, etc.

Figure 9:
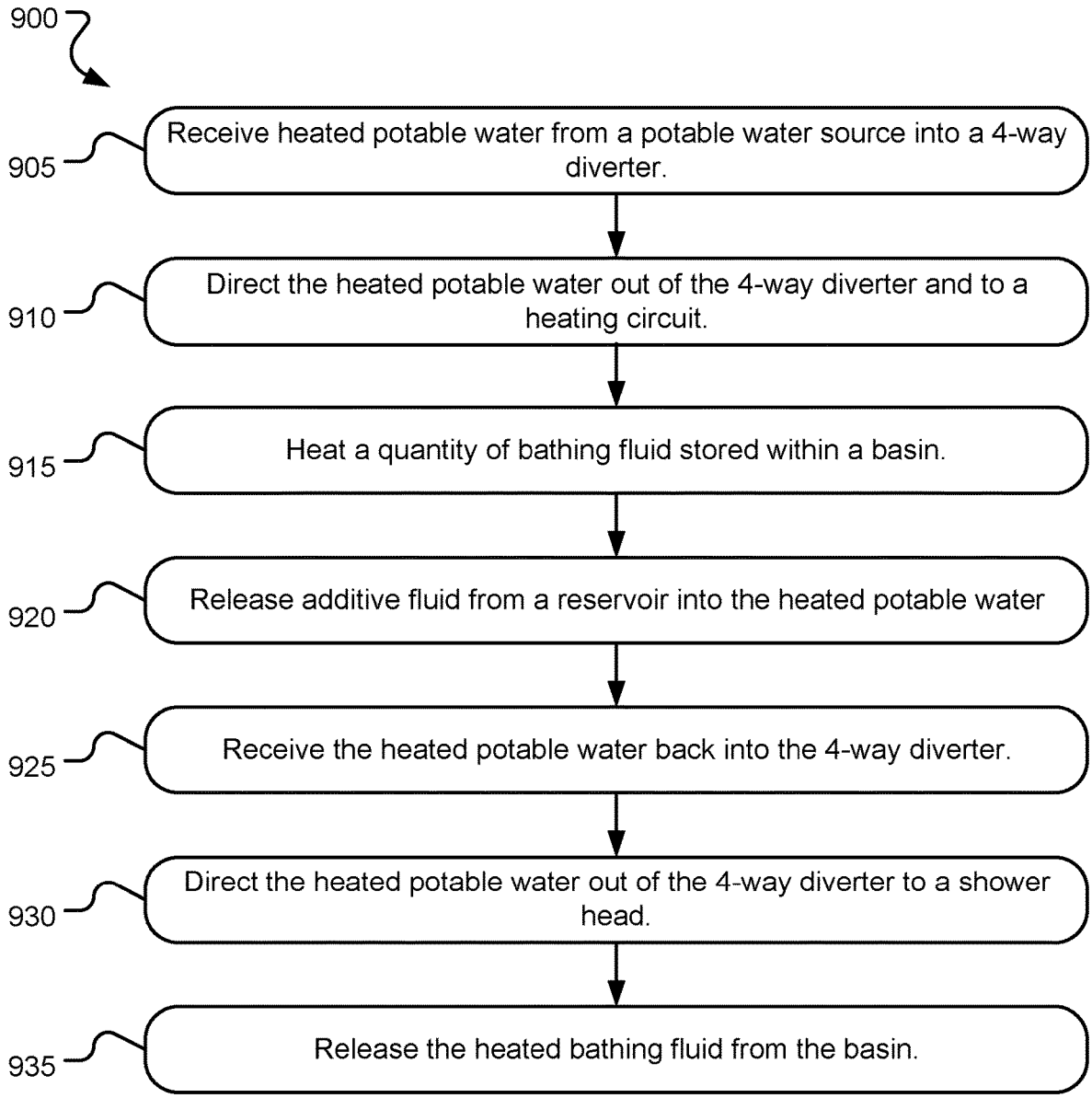
FIG. 9 illustrates example operations for using a shower caddy with an additive infuser and a heated dispenser.

FIG. 9 illustrates example operations 900 for using a shower caddy with an additive infuser and a heated dispenser. A receiving operation 905 receives heated potable water from a potable water source into a 4-way diverter. The 4-way diverter is a component of the caddy and the incoming heated potable water may be incoming from a shower arm. A directing operation 910 directs the heated potable water out of the 4-way diverter and to a heating circuit.

A heating operation 915 heats a quantity of bathing fluid stored within a basin. The heating circuit extends through the basin to conduct thermal energy from the heated potable water flowing through the heating circuit to the bathing fluid within the basin. The heating operation 915 may be performed by the heated fluid dispensers disclosed herein. A first releasing operation 920 selectively releases additive fluid from a reservoir into the heated potable water flowing through a circuit of pipes connected to the 4-way diverter. The first releasing operation 920 may be performed by the additive infusers disclosed herein.

A receiving operation 925 receives the heated potable water back into the 4-way diverter from the heating circuit. A directing operation 930 directs the heated potable water out of the 4-way diverter to a showerhead. A second releasing operation 935 selectively releases the heated bathing fluid from the basin.

Additional example operations for using the presently disclosed technology follow. A detaching operation detaches an existing showerhead from a shower arm, which may include unscrewing the showerhead. An attaching operation attaches a 4-way diverter of a shower caddy to the shower arm, which may include screwing the 4-way diverter to the shower arm. A reattaching operation reattaches the showerhead to the 4-way diverter of the caddy, which may include screwing the showerhead to the 4-way diverter. The showerhead may be an existing or new showerhead. An attaching operation attaches an additive fluid container to an additive infuser of the caddy. A depositing operation deposits bathing fluid (e.g., oil, shampoo, or lotion) into a basin of a heated fluid dispenser of the caddy. The depositing operation may include sliding the basin outward such that the material can be deposited into the basin and then sliding the basin inward to close the basin.

An activating operation activates water in the shower. The water is received at the 4-way diverter, diverted through a water conveyance system (or circuit of pipes) and to the heated fluid dispenser and the additive infuser, received back at the 4-way diverter, and output via the attached showerhead. A heating operation heats the materials deposited into the basin of the heated fluid dispenser using the water. An engaging operation engages an activation apparatus of the additive infuser to infuse an additive into the water stream that is output via the showerhead. A dispensing operation dispenses heated materials from the basin of the heated fluid dispenser using a discharge valve and/or pump.

The logical operations disclosed herein may be performed in any order, adding or omitting operations as desired, unless explicitly claimed otherwise or a specific order is inherently necessitated by the claim language.

The above specification, examples, and data provide a complete description of the structure and use of example embodiments of the disclosed technology. Since many embodiments of the disclosed technology can be made without departing from the spirit and scope of the disclosed technology, the disclosed technology resides in the claims hereinafter appended. Furthermore, structural features of the different embodiments may be combined in yet another embodiment without departing from the recited claims.

What is claimed is:

1. A shower caddy comprising:
a heated fluid dispenser including:
a basin defining a volume of bathing fluid to be deposited within the basin;
one or more discharge valves to selectively release the bathing fluid from the basin; and
a heating circuit to be in direct contact with the bathing fluid, the heating circuit extending through the basin to conduct thermal energy from heated potable water flowing through the heating circuit to the bathing fluid within the basin; and
a 4-way diverter including:
a first input to receive the heated potable water;
a first output to direct the heated potable water to the heating circuit;
a second input to receive the heated potable water back from the heating circuit; and
a second output to direct the heated potable water out of the shower caddy.

2. The shower caddy of claim 1, further comprising:
a frame physically supporting the heated fluid dispenser, the 4-way diverter, and a circuit of pipes fluidly connecting the heated fluid dispenser and the 4-way diverter.

3. The shower caddy of claim 2, further comprising:
one or more of a storage basket, storage hooks, and a shelf attached to the frame.

4. The shower caddy of claim 2, wherein the shower caddy includes a connector to attach the shower caddy to one or both of a shower arm and a shower wall.

5. The shower caddy of claim 1, wherein the bathing fluid is adapted to be solid or semi-solid at room temperature and liquid at a temperature of the heated potable water.

6. The shower caddy of claim 1, wherein the basin includes one or more internal dividers defining two or more internal compartments, and wherein each of two or more compartments includes one of the one or more discharge valves to selectively release the bathing fluid from the basin.

7. The shower caddy of claim 1, further comprising:
a showerhead fluidly connected to the second output of the 4-way diverter, the showerhead including an integrated water softener.

8. A shower caddy comprising:
a heated fluid dispenser including:
a basin defining a volume of bathing fluid to be deposited within the basin;
one or more discharge valves to selectively release the bathing fluid from the basin; and
a heating circuit to be in direct contact with the bathing fluid, the heating circuit extending through the basin to conduct thermal energy from heated potable water flowing through the heating circuit to the bathing fluid within the basin;
a 4-way diverter including:
a first input to receive the heated potable water;
a first output to direct the heated potable water to the heating circuit;
a second input to receive the heated potable water with an additive fluid back from the heating circuit; and
a second output to direct the heated potable water with the additive fluid out of the shower caddy; and
an additive infuser including:
a reservoir to store a quantity of the additive fluid; and a user selector to selectively release the additive fluid from the reservoir into the heated potable water flowing through the heating circuit connected to the 4-way diverter.

9. The shower caddy of claim 8, further comprising:

a frame physically supporting the additive infuser, the 4-way diverter, and the heating circuit fluidly connecting the additive infuser and the 4-way diverter.

10. The shower caddy of claim 9, further comprising:

one or more of a storage basket, storage hooks, and a shelf attached to the frame.

11. The shower caddy of claim 9, wherein the shower caddy includes a connector to attach the shower caddy to one or both of a shower arm and a shower wall.

12. The shower caddy of claim 8, wherein the user selector actuates a valve that permits introduction of the additive fluid into the heated potable water via a venturi injector.

13. The shower caddy of claim 8, wherein the user selector is a manual pump that pressurizes the reservoir thereby discharging the additive fluid from the reservoir into the heated potable water.

14. The shower caddy of claim 8, wherein the user selector actuates a pump that discharges the additive fluid from the reservoir into the heated potable water.

15. The shower caddy of claim 8, the user selector to meter a specific quantity of additive fluid from the reservoir over a preselected period of time into the heated potable water regardless of duration of selection or number of selections of the user selector.

16. The shower caddy of claim 8, further comprising:

a showerhead fluidly connected to the second output of the 4-way diverter, the showerhead including an integrated water softener.

17. A method of using a shower caddy comprising:

receiving heated potable water from a potable water source into a 4-way diverter;

directing the heated potable water out of the 4-way diverter and to a heating circuit;

heating bathing fluid stored within a basin using the heating circuit, the heating circuit extends through the basin to conduct thermal energy from the heated potable water flowing through the heating circuit to the bathing fluid in direct contact with the heating circuit within the basin, the basin defines a volume of bathing fluid to be deposited therein;

selectively releasing the heated bathing fluid from the basin using one or more discharge valves;

receiving the heated potable water back into the 4-way diverter from the heating circuit; and directing the heated potable water out of the 4-way diverter to a showerhead.

18. The method of claim 17, further comprising:

selectively releasing additive fluid from a reservoir into the heated potable water flowing through a circuit of pipes connected to the 4-way diverter.

* * * * *